United States Patent [19]

Funke

[11] 4,372,289

[45] Feb. 8, 1983

[54] FLUE BOX ASSEMBLY

[76] Inventor: Craig D. Funke, 14640 Chicago Rd., Dalton, Ill. 60419

[21] Appl. No.: 149,849

[22] Filed: May 22, 1980

[51] Int. Cl.[3] ..... F23L 11/00; F23L 13/00

[52] U.S. Cl. ..... 126/292; 236/49; 126/312

[58] Field of Search ..... 126/285 R, 292, 293, 126/307 A, 312, 300, 301, 302, 289; 431/20; 236/49; 165/DIG. 11

[56] References Cited

U.S. PATENT DOCUMENTS

| | | | |
|---|---|---|---|
| 586,571 | 7/1897 | Slentz | 126/293 |
| 4,136,676 | 1/1979 | McCown | 126/292 |

FOREIGN PATENT DOCUMENTS

| | | | |
|---|---|---|---|
| 1051046 | 1/1954 | France | 126/292 |
| 17059 | 7/1910 | United Kingdom | 126/292 |

*Primary Examiner*—James C. Yeung

*Attorney, Agent, or Firm*—Basil E. Demeur; Robert E. Knechtel; Alan B. Samlan

[57] ABSTRACT

An improved flue box assembly for use with the exhaust gas conduit of a heating plant is provided having a housing with at least one pivotally mounted damper plate therein. The damper plate is provided with a flue opening and at least one bore to permit the creation of a safe amount of back pressure to retain unburned fuel vapors within the heating plant, thereby maximizing fuel efficiency, while simultaneously preventing the build-up and stratification of unburned fuel vapors within the housing.

8 Claims, 6 Drawing Figures

FLUE BOX ASSEMBLY

BACKGROUND OF THE INVENTION

The present invention pertains to an improved flue box assembly for use in conjunction with heating plants to safely insure substantially complete combustion of the fuels in the heating plant, and more particularly, to such a device employing a movable damper means having flue openings in the damper plate.

It has become increasingly important for energy conservation to provide a device which will insure substantially complete combustion of all the fuel vapors in heating plants, or, hereinafter, furnace boxes, such as home furnaces, water heaters, boilers, etc. In U.S. Pat. No. 4,136,676, a flue box device for use in conjunction with the exhaust outlet of a heating plant is described which is particularly suited for safely accomplishing this purpose. That device has been found to exhibit vast improvements in creating safe back pressures to retain the waste gases and fuel vapors within the combustion chamber of the heating plant until virtually all of the fuel is consumed into usable heat. When installed in the pathway of the exhaust or waste gas conduit emanating from the heating plant or heat source, that device provides a movable damper plate which retains the bulk of the gases within the combustion chamber to the point of insuring maximum energy efficiency. The movable damper can safely assume an open position to provide an enlarged chamber during an excessive back pressure or explosive situation. A flue opening is provided in that damper plate which is diametrically smaller than either the inlet or outlet apertures to the housing. In an explosive situation, the increased upward draft pressure of unburned and possible waste gases will cause the damper plate to swing open thereby safely avoiding excess vapor build up and the possibility of an explosion or suffocation.

Prior to the commercially successful flue box as disclosed in U.S. Pat. No. 4,136,676, various types of devices had been developed which were designed to accomplish fuel efficiency.

For example, U.S. Pat. No. 1,196,117, illustrates a damper plate which is employed in the exhaust line of a furnace and consists of a pivotally mounted plate seated over a sheet metal exhaust tube. The damper plate retains the bulk of the exhaust or waste gases within the furnace assembly until they are combusted. It will be noted in connection with this disclosure, that the external perimeter of the sheet metal waste pipe is provided with a plurality of circumferentially disposed recesses in order to permit the escape of some of the flue gases during combustion, while the damper plates insures that the bulk of the gases will remain in the furnace until fully combusted. Similar devices are shown by U.S. Pat. No. 1,580,106 wherein a damper plate is apertured to permit the exhaust of some waste gases during the combustion process.

During any back pressure or explosive situation, means must be provided for waste gases to immediately exhaust themselves from the furnace so that a destructive explosion will not occur. It is for this reason that damper plates which are provided along the exhaust pathway of the tubing are provided in a pivotable or otherwise movable fashion. It is intended that during a back pressure or explosive situation, the pivotally mounted damper plate will move to a fully open position and permit the waste gases to be immediately exhausted from the combustion chamber. The difficulty with the prior art devices is that the diametric size of the exhaust pipe immediately above the damper plate has been virtually the same as or less than the diametric sizing of the exhaust pipe immediately below the damper plate. As a result, there is still a danger that the exhaust gases, during a back pressure or explosive situation cannot be quickly exhausted through the waste pipe, and hence, the danger of an explosive situation with regard to the entire furnace is still present.

The commercially successful flue box as disclosed in U.S. Pat. No. 4,136,676, provides a safe solution to this energy conservation problem. The damper plate of that device will be automatically fully opened in the event of a fuel vapor build up problem or a delayed ignition of the fuel vapors to safely eliminate the dangers of explosion and suffocation.

During start up of a relatively cold heating plant, in the sense of not having any substantial amount of retained heat, the draft or venting capabilities for drawing off waste gas products is at its lowest point. During a cold start-up of a heating plant, the combustion chamber and flue conduit surfaces are cold causing stratification of the denser unburned fuel products near the surfaces of the flue box and exhaust conduit. As the pilot begins to burn the fuel, and produce hot exhaust gases, a channeling effect occurs wherein a central column of hotter gases is created which may cause a build up of unburned fuel vapors below the damper plate in the flue box assembly disclosed in U.S. Pat. No. 4,136,676. This phenomena is more apparent in devices containing a fluidic heat transfer system, such as boilers or water heaters, which cool much more quickly thereby decreasing the natural draft effect which would be facilitated by a warm heating plant.

SUMMARY OF THE INVENTION

The present invention provides an improvement over prior art devices by eliminating stratification of unburned fuel vapors during cold start-ups of heating plants without any decrease in fuel efficiency. This result is unexpectedly achieved by providing a series of bores strategically placed in the damper plate to eliminate the potential for stratification of waste and unburned gases during cold start-ups without sacrificing efficiency.

In accordance with the foregoing object, it is a further advantage to provide an improved flue box assembly which minimizes the dangers of back pressures or explosive situations during cold start ups of a heating plant and further, at any time during the operation of the heating plant to quickly and efficiently exhaust gases from the furnace.

BRIEF DESCRIPTION OF THE FIGURES

Other objects of this invention will become apparent as the description proceeds in connection with the accompanying drawings, of which.

DETAILED DESCRIPTION OF THE PREFERRED EMBODIMENTS

Briefly, the device of the present invention includes an improved flue box assembly of the type described in the commonly owned U.S. Pat. No. 4,136,676 which has a housing of substantially greater diametric configuration than either the outlet or the inlet apertures to the housing. A damper means or damper plate is pivotally mounted within the body so as to assume a horizontal or closed configuration or a vertical and/or an open configuration relative to a vertical orientation of the housing. The damper plate has a flue opening and a series of bores in the plate to optimize safety during cold start ups of a heating plant and to maximize energy conservation by the creation of an optimally safe amount of back pressure. The combined area of the flue opening and other bores is smaller than the area of either the inlet or the outlet to the housing.

Figure 1:
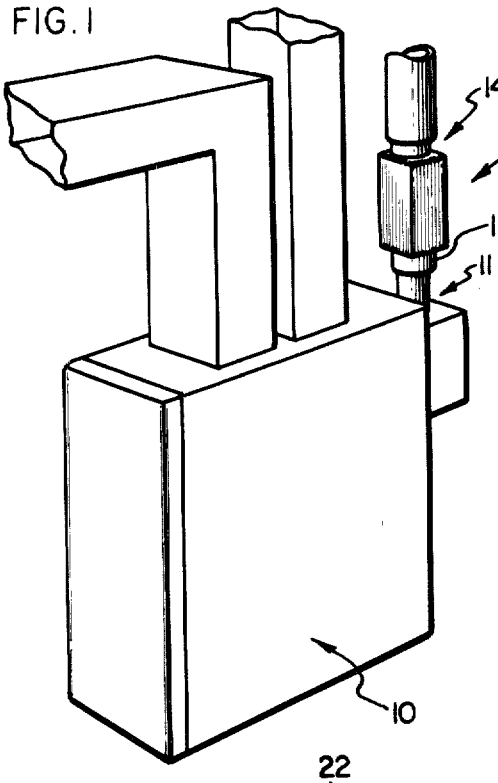
FIG. 1 is a perspective view showing a representative heating plant having a waste gas conduit with the flue box assembly of the present invention.

Turning now to the drawings, as shown in FIG. 1, there is illustrated a typical heating plant, such as a furnace box, boiler, water heater or other conventional heat source 10 which is shown to include a flue or waste gas conduit 11 eminating therefrom. A flue box device 12 receives the waste gases from the conduit through an inlet 13. The exhaust gases pass from the heating plant 10 and through the flue box 12 and out to the atmosphere through an outlet conduit 14.

Figure 2:
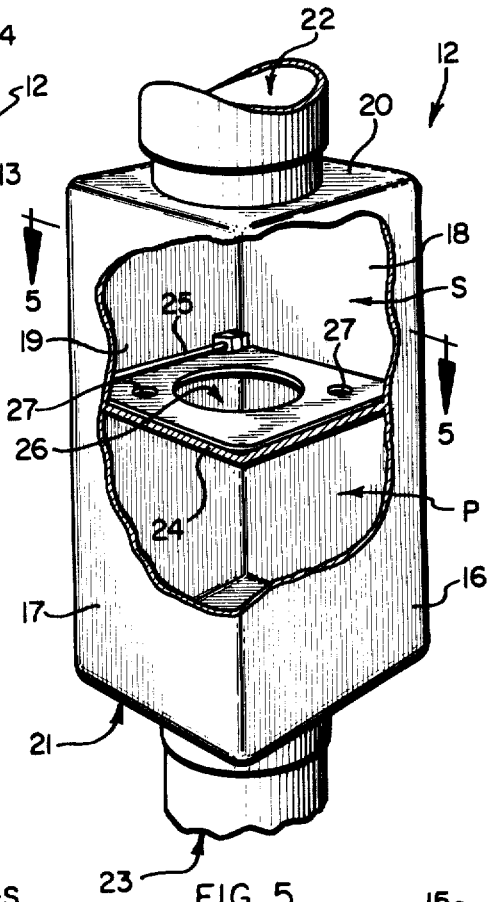
FIG. 2 is a perspective, partly in cross-section, showing the details of the damper means within the present invention.

As shown in FIG. 2, the flue box 12 has a housing 15 which includes a plurality of four sidewalls 16, 17, 18, and 19 respectively, arranged in a continuous fashion to completely enclose the housing 15 around the side portions thereof. The housing 15 also includes a top wall 20 and a bottom wall 21, the top wall 20 has an outlet aperture 22 and the bottom wall 21 has an inlet aperture 23.

While the flue box assembly 12 and specifically the housing 15 thereof, is shown to be basically rectangular in configuration, it should be noted that the housing 15 may be in any configuration, such as circular or square. The criticality resides in the fact that the internal volume and diametric sizing of the housing 15 is dimensioned greater than either the outlet aperture 22 or the inlet aperture 23 in the top wall 20 and bottom wall 21 respectively.

A damper plate 24 is diametrically sized to fit within the housing 15, as shown. The damper plate 24 is pivotally mounted along one of the sidewall portions 19 by any suitable means, such as a pivotal pin 25. The damper plate 24 has a flue opening 26 which, as shown, has a smaller diametric sizing than either the outlet 22 or inlet 23 apertures. When the damper 24 is in a closed position as depicted in FIGS. 1 and 2, the waste gases will exhaust from the heating plant 10 and conduit 11, through the inlet aperture 23 to the housing 15, and will be forced through the flue opening 16 in the damper plate 14 and exit through the outlet aperture 22 of the housing 15. Hence, the damper plate 24 will create a safe back pressure to retain the waste gases in the furnace box until substantially complete combustion has been effected. The device as thusfar described is the same as the preferred embodiment of the aforementioned U.S. Pat. No. 4,136,676, and reference to that patent may be made for additional descriptive details.

The present invention is involved with the addition of a series of bores 27 provided in the damper plate 24 as shown. At least one bore, and preferably two or more are positioned in the damper plate 24 radially outwardly from the flue opening 26 for enhancing the draft of unburned fuel vapors during start up of the heating plant 10.

Figure 3:
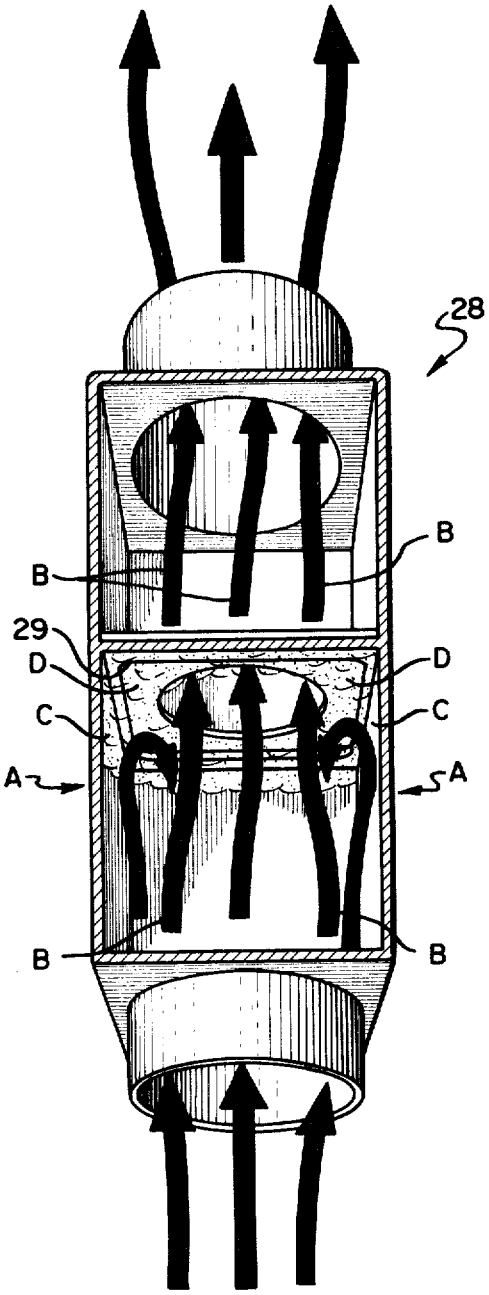
FIG. 3 PRIOR ART
FIG. 3 illustrates the flue box assembly of U.S. Pat. No. 4,136,676 and graphically depicts vapors during a cold start up of a heating plant.

As shown in the device of FIG. 3, during start up of the heating plant it is possible that some stratification of unburned fuel vapors may collect around the interior peripheries of the housing 15. Generally, when a heating plant is started up, a fuel valve is opened and fuel, in liquid and/or vapor form, enters a combustion chamber and a pilot initiates combustion of the fuel. When the heating plant is cold, there is no retained heat to create an upward draft. As illustrated in region A of FIG. 3, during cold start up, it is possible for a channeling effect to occur. The fuel vapors or mixture travels the path of least resistance through the center of the prior flue box assembly 28 as graphically represented by the arrows B. This channeling is principally due to the cold surfaces which have not yet warmed to create an efficient upward drafting effect. Consequently, as shown in region C, some unburned fuel vapors D, which are cooler and much denser than the warmer exhaust gases B, may have a tendency to collect and stratify around the periphery of a damper plate 29 in the lower region of the flue box assembly 28.

Figure 4:
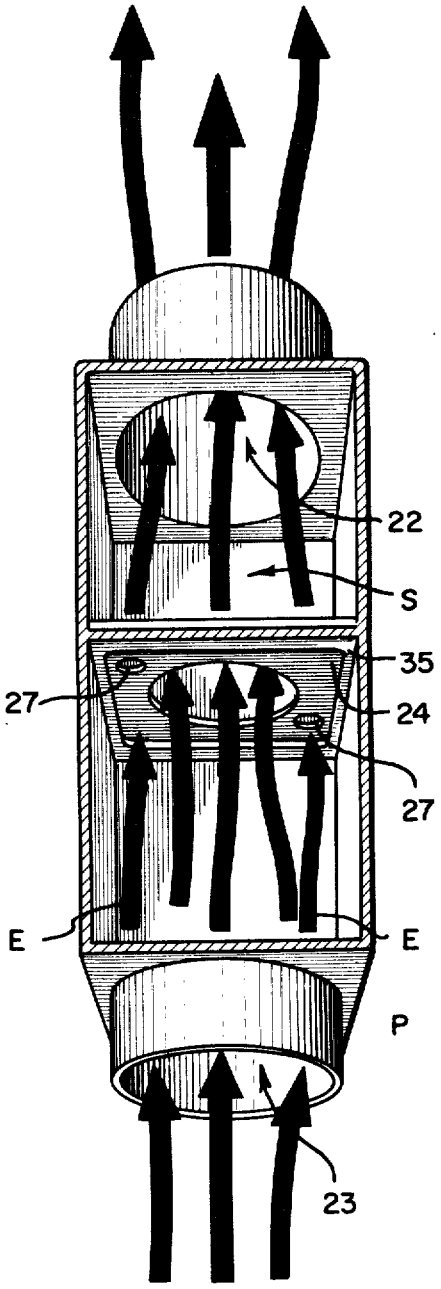
FIG. 4 is a perspective view illustrating an embodiment of the present invention under the same circumstances of FIG. 3.

Turning to a preferred embodiment of the present invention as shown in FIG. 4, the damper plate 24 optimizes safety during cold start up and eliminates stratification of the unburned fuel vapors. While the system is cold during start up and the drafting effect is poor, the bores 27 in the damper plate 24 permit an upward acceleration of the waste gases and the denser unburned fuel vapors depicted by arrows E. The upward acceleration created by the bores 27 prebents stratification of gases in the lower chamber of the flue box assembly 12.

Figure 5:
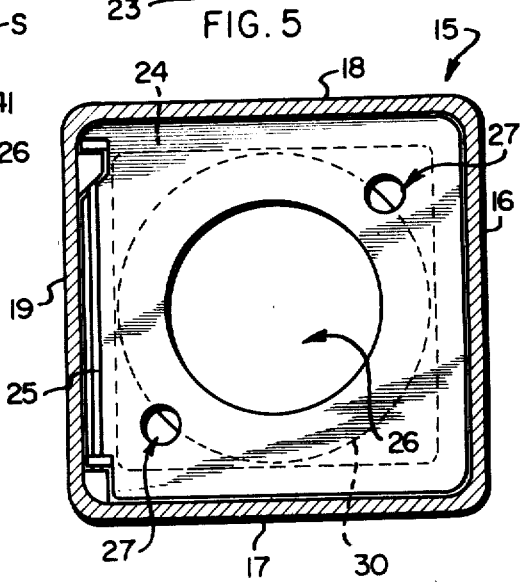
FIG. 5 is a top view taken along line 5—5 of FIG. 2, illustrating the relationship between the damper plate and the furnaced exhaust opening.

Turning to FIG. 5, a comparison of the inlet opening 23 area is circumscribed in phantom 30 as compared to the combined areas of the flue opening 26 and two bores 31 and 32. It is critical to the present invention that the combined areas of the flue opening, plus the summation of the areas of the bore openings be smaller than the total area of the smaller of either the inlet 23 or outlet 22 openings. The inlet 23 and outlet 22 openings will not always have the same areas and, in that event, the smaller of the two is the critical area. As shown in FIGS. 2, 4 and 5, only two bores are provided in the damper plate 24. However, any number of additional bores could be provided of varying sizes along the damper plate 24, such as shown, for example, in FIG. 6. Providing the damper plate 24 with additional bores, may, depending upon the area of the boxes, require that the diameter of the flue opening 26 be reduced to maintain a combined area of the bores and flue opening which is less than the smaller area of either the inlet 23 or the outlet 22.

The combined area of the flue opening and all of the series of bores is preferably about forty percent of the smaller of the inlet or outlet opening area. The dimensions of the flue box assembly and the flue and bore openings will be dependent upon the overall venting capacity of a particular system prior to installation of the flue box assembly. For example, a total vent height of 22 feet above the outlet opening of the flue box and a chimney of 50% greater area than that of flue outlet from the heating plant will require less back pressure or restriction by the flue box device than in an installation having 35 feet of vent and a chimney size 200% greater the flue outlet from the heating plant. It will be understood that smaller flue and bore openings will create more back pressure or restriction than larger flue and bore openings for the same size flue box. Additionally, the amount of back pressure can be varied by altering the overall volume of the unit relative to the area for a particular flue outlet from the heating plant.

In operation of the flue box assembly as depicted in the FIGS. 1, 2, 4 and 5, waste gases from the heat source will enter through the inlet 23 in the bottom wall 21 of the flue box 12. The waste gases will then expand to fill the volume of a primary entry region, illustrated generally as element P. The volume of the entry expansion chamber or P is defined by the damper plate 24 in a closed position resting against a suitable stop means, such a peripheral ledge 35, at its upper end, and by the lower wall 21.

The velocity of the waste gases will be considerably slowed as they enter and expand into the greater diametric sizing of the housing 15 into region P. As the drafting phenomena carries the waste gases upwardly, they will encounter resistance by having to pass through the flue opening and the series of bores in the damper plate 24, which will remain closed during normal waste gas pressures. As the waste gases pass through the bores and flue opening, the velocity will increase and then immediately be slowed again as they enter the expanse of a secondary exit chamber, denoted generally by element S. Additional resistance or back pressure will be created as the waste gases are reduced in volume from the exit or second expansion chamber S to pass through the outlet conduit 14.

In this manner, the present invention creates a safe back pressure to permit a more efficient and substantially complete burning of the fuel in the heat source. The bores in the damper plate 24 of the present invention eliminate the time period during cold start ups wherein unburned fuel vapors D are stratified as shown in FIG. 3. There is no decrease in fuel efficiency with the present invention compared to the prior art device of FIG. 3, due to the fact that any unburned fuel vapors, which could be stratified in the flue box during start up, would also be eventually lost with the prior art devices. Specifically, as shown in FIG. 3, the fuel vapors D in region C during start will be mixed with the upward draft A during increasing heat and be vented and not consumed.

In the present invention, the damper plate will permit safe and efficient exhausting of gases during an explosive situation. A rush of unburned gases may occur, for example, by a delayed ignition during start up of the heating plant. However, the pivotally mounted damper plate will be forced into a fully opened position if this unlikely event does occur. In the situation of a sudden rush of exhaust or unburned fuel vapors, the opened damper plate allows the combined internal volume of the housing to accommodate the sudden increase in pressure to permit a safe exit path through the outlet conduit.

Figure 6:
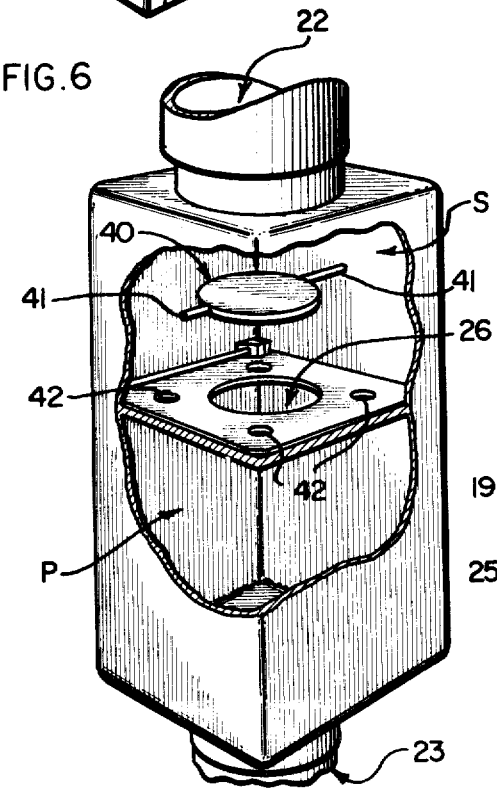
FIG. 6 is a perspective view with a cut away section illustrating an alternative embodiment of the flue box assembly.

Another embodiment of the present invention is shown in FIG. 6 and includes a baffle plate 40 in the secondary exit chamber S. The baffle 40 is preferably mounted, in a suitable manner such as by support pins 41, to be substantially concentric with the flue opening 26. The baffle 40 is mounted in a stationary manner and creates an additional impediment to the upwardly drafting waste gases as they travel from the flue opening through the exit chambers S and out the exhaust opening 22.

The baffle 40 is particularly suitable for use with a larger flue box assembly which is required by a large diameter flue conduit from the heating plant. In larger installations, the flue opening and bore sizes in the damper plate may require a greater combined area, although smaller than either the inlet or the outlet conduits. For example, the damper plate 24, shown in FIG. 6, has four bores 42 to provide additional upward drafting. This increased area of the flue opening 26 and bores 42 may not permit the desired or optimum amount of restriction to the upward draft velocity of the waste gases. The baffle plate 40 will create an impediment to the waste gas flow. This serves to create some additional back pressure to safely retain the gases within the furnace until combustion is completed.

The present invention can be fabricated from a variety of materials such as, for example, sheet metal or cast aluminum. The pivot pin for the damper plate can be of any suitable material, however, preferably the pin is made of stainless steel to eliminate any potential for corrosion which may hinder the free swinging motion of the damper plate. Additionally, it will be understood that while two expansion chambers defined by one damper plate have been disclosed herein, additional damper plates may be added within the housing thereby defining a series of greater than two expansion chambers. While the flue opening has been illustrated to be larger than the bores, the present invention includes a damper plate having bores and a flue opening more similar in size, or equal in area.

Although the invention has been described in terms of preferred structures and alternate embodiments, it will be apparent that additional modifications may be made without departing from the invention. It is intended that all such modifications be included within the spirit and scope of the invention as defined herein and protected by the appended claims.

What is claimed is:

1. In a flue box assembly for conserving fuel consumption in conjunction with a heating plant having a housing with an interior diametric opening substantially greater than the exhaust gas inlet to and outlet from the interior of the housing, a damper means having a flue opening diametrically smaller than either the inlet or the outlet apertures to the housing, said damper means being pivotally mounted within said housing to permit movement of said damper means between a closed position overlying said inlet aperture and an open position; the improvement comprising:

at least one bore in said damper means disposed radially outwardly from said flue opening for enhancing the draft of unburned fuel vapors during start up of the heating plant, wherein the combined area of the bore and the flue opening is smaller than the area of the inlet or the outlet to the housing, thereby eliminating stratification of high concentrations of fuel mixture during start up of the heating plant.

2. The flue box of claim 1, wherein the damper means includes a damper plate with the flue opening centrally positioned in the damper plate and a series of two or more bores positioned along the damper plate.

3. The flue box of claims 1 or 2 wherein the damper means includes a damper plate with the flue opening centrally positioned in the damper plate and two bores diagonally positioned from one another near the outer periphery of the damper plate.

4. The flue box of claim 3 further including at least one baffle mounted within the housing between the damper plate and the exhaust gas outlet.

5. The flue box of claim 4 wherein one circularly-shaped baffle is horizontally mounted between the damper plate and the exhaust so as to be substantially concentric with the flue opening in the damper plate.

6. The flue box of claims 1 or 2 wherein the combined area of the bore and flue openings in the damper plate is approximately equal to forty percent of the smaller of either the area of the inlet or the outlet.

7. The flue box of claim 1 wherein the damper means includes more than one damper plate pivotally mounted and spaced from one another within said housing to permit movement of said more than one damper plate to a fully open position by a sudden rush of gases eminating from said heating plant.

8. In a flue box assembly for conserving fuel consumption in conjunction with a heating plant having a housing with an interior diametric opening substantially greater than the exhaust gas inlet to and outlet from the interior of the housing, a damper means having a flue opening diametrically smaller than either the inlet or the outlet apertures, in the housing said damper being pivotally mounted within said housing to permit movement of said damper means between a closed position overlying said inlet aperture and an open position; the improvement comprising:

a damper plate having one or more bores disposed radially outwardly from said flue opening for enhancing the draft of unburned fuel vapors during start up of the heating plant, wherein the combined area of the bore and the flue opening is smaller than the area of the inlet or the outlet to the housing, thereby eliminating stratification of high concentrations of fuel mixture during start up of the heating plant; and at least one baffle mounted within the housing between the damper plate and the exhaust gas outlet, whereby high concentrations of fuel mixtures within the housing are alleviated during start up and permitting a safe amount of back pressure to effectively permit efficient combustion of fuel by the heat source.

* * * * *